United States Patent [19]

Ehlis

[11] Patent Number: 4,826,562

[45] Date of Patent: May 2, 1989

[54] DEVICE FOR UNWINDING TRANSFER TAPE FROM A ROLL

[75] Inventor: Uwe Ehlis, Remscheid, Fed. Rep. of Germany

[73] Assignee: doro tape Ehlis KG, Fed. Rep. of Germany

[21] Appl. No.: 196,959

[22] Filed: May 20, 1988

[30] Foreign Application Priority Data

May 28, 1987 [DE] Fed. Rep. of Germany ..... 3718065

[51] Int. Cl.[4] ..... B26F 3/02

[52] U.S. Cl. ..... 156/523; 156/540; 156/577; 156/579

[58] Field of Search ..... 156/523, 527, 540, 541, 156/577, 579, 584

[56] References Cited

U.S. PATENT DOCUMENTS

| | | | |
|---|---|---|---|
| 602,949 | 4/1898 | Kunkle | 156/540 |
| 1,231,094 | 6/1917 | Swallow | 156/540 |
| 3,740,299 | 6/1973 | Schoter et al. | 156/577 |
| 3,902,956 | 9/1975 | Thompson | 156/523 |
| 3,930,927 | 1/1976 | Thompson et al. | 156/577 X |
| 3,969,181 | 7/1976 | Seabold | 156/577 |
| 4,718,971 | 1/1988 | Summers | 156/579 X |

*Primary Examiner*—Michael W. Ball
*Assistant Examiner*—Steven D. Maki
*Attorney, Agent, or Firm*—Toren, McGeady & Associates

[57] ABSTRACT

In a device for unwinding from a roll a backing tape having double-sided adhesive tape adhering thereto, comprising a housing containing a wind-off and a take-up sleeve operatively connected to one another by unlockable cogwheels and, projecting from the housing, a freely rotatable application roller around which the tape unwinding from a supply spool on the wind-off sleeve to the take-up sleeve is looped, easy operation can be achieved if a spring-loaded supporting plate is provided which carries the complete unwinding mechanism and is arranged in the housing so as to pivot about an axis in the housing floor and if a pin, fixed to the housing floor can be engaged in a tooth gap of a cogwheel.

6 Claims, 2 Drawing Sheets

DEVICE FOR UNWINDING TRANSFER TAPE FROM A ROLL

TECHNICAL FIELD OF THE INVENTION

The invention relates to a device for unwinding a backing tape or strip having adhering to it double-sided adhesive tape (hereinafter referred to as tape), comprising a housing containing a wind-off and a take-up sleeve or spindle operatively connected to one another by unlockable cogwheels and, projecting from the housing, a freely rotatable application roller around which the tape being unwound from a supply spool the wind-off sleeve to the take-up sleeve is looped.

BACKGROUND OF THE INVENTION AND PRIOR ART

A tape dispenser is known from DE-OS No. 31 09 735 which has an exchangeable supply spool of adhesive tape on a wind-off sleeve in a housing. The wind-off sleeve is formed integrally with a push button which is arranged so as to slide in the housing and under the force of a spring projects from the housing through a lateral opening. On the side of the housing opposite the push button there is a window with a tape pressing roller for applying adhesive tape unwound from the wind-off sleeve. When unwinding the adhesive tape from the supply spool on the wind-off sleeve, which requires the user of the device to press the push button against the force of the spring, the tape pressing roller cooperates with a tape guiding roller as well as with a tape deflecting roller. While the tape deflecting roller deflects the adhesive tape pulled off from the supply spool, the tape pressing roller presses the non-adherent side of the adhesive tape onto the support.

In order to automatically unwind the adhesive tape from the roll, which is secured against undesired rotation by an integral spring in the wind-off sleeve, on pressing the push button, the deflecting roller is pressed against the surface of the object to which the adhesive tape is to be applied and the leading end of the tape is struck down. By moving the device counter to the winding of the supply spool an adhesive tape strip of the desired length is unwound. Separation of the strip of adhesive tape applied from the supply roll is effected by a toothed rack on the push button which meshes with teeth on a disc having a cutting knife on its periphery. Pushing the push button causes the disc and cutting knife to turn clockwise, but when the pressure on the push button is released they move anti-clockwise as the spring relaxes until the cutting knife arrives at a position beneath the deflecting roller and separates the adhesive tape.

Apart from the very complicated and expensive separating mechanism, threading a new supply spool in is also exceptionally troublesome and requires much dexterity. Before the new supply spool can be placed on the wind-off sleeve it is necessary to unwind a strip of adhesive tape from the supply spool by hand and to place the leading end of the tape beneath the tape deflecting roller. The supply spool is then placed on the wind-off sleeve and is secured against undesired, independent rotation by the spring which presses a lug against the supply spool from the inside through the wind-off sleeve.

A further known unwinding device, closable with a lid, has inside its housing a wind-off sleeve over which exchangeable push-on supply spools of backing tape with double-sided adhesive tape adherent thereto (the backing tape with adhesive tape will hereinafter be termed transfer tape) and also a take-up sleeve. The two sleeves are operatively connected by cogwheels meshing with one another. Spaced from the two sleeves is an application roller having a part of its surface projecting outwards through a side opening in the housing wall, and having the transfer tape looped around it. When inserting a new supply spool, which has internal axial slots to receive external axial ribs on the wind-off sleeve to give a shape-locked connection, the leading end of the tape has to be placed around the application roller and—like film spools—threaded into a slit in the take-up sleeve. In addition, either before or after the threading, the adhesive film has to be removed by hand from the leading end of the transfer tape.

In this known unwinding device a brake lever is pivotably mounted on an axis in the housing floor. One end of this lever engages with a lug in the cogwheel of the wind-off sleeve, and the other end projects outwardly through an opening in the housing and forms a push button. By pressing the push button the lug is disengaged from the cogwheel of the wind-off sleeve and the sleeve is thus unlocked. By pressing the application roller against the object to which the adhesive strip is to be applied and simultaneously moving the device, the adhesive tape is separated from the backing tape and the backing tape is wound onto the take-up sleeve. On releasing the push button the lug engages with the cogwheel so that the wind-off sleeve is locked and the strip of adhesive tape is torn off. The use of this device thus also requires exceptional skill and dexterity when inserting a new supply spool and threading the leading end of the tape as well as in pressing down the brake lever with a finger when applying the adhesive strip.

OBJECT OF THE INVENTION

The object of the invention is to provide an unwinding device which is easy to operate.

BRIEF DESCRIPTION OF THE INVENTION

According to the invention this object is achieved by arranging the whole of the unwinding mechanism on a spring-loaded supporting plate which is arranged in the housing so as to pivot about an axis in the housing floor, which in addition has a pin which can be engaged in a tooth gap of a cogwheel. In an unwinding device provided with a supporting plate of this kind, the pressure which is required to apply the adhesive tape can at the same time be used to unlock the cogwheels without the need for a brake lever which might also have to be pressed down. This is because pressure on the application roller causes the supporting plate to pivot about its axis and the pin, which is engaged in the cogwheel of either the wind-off sleeve or the take-up sleeve, to be displaced relative to the supporting plate into a disengaged position away from the cogwheel. If the arrangement or dimensions of the supporting plate is such that it covers the pin, the pin can advantageously project into a slot-like opening or recess in the supporting plate. The opening provides the pin with enough room for it to engage in the tooth gap.

As long as the pressure is maintained during application, the backing tape with the adherent double-sided adhesive tape can unwind from the supply spool and the backing tape that has been freed from the adhesive tape can wind onto the empty spool on the take-up sleeve.

When the pressure ceases to act the spring, which is preferably formed as a spring arm branching from the supporting plate, automatically swings the supporting plate about the axis back to its starting position. The pin, which is advantageously wedge-shaped towards the cogwheel, then again engages in a tooth gap of the cog wheel in the position locking the movement of the spool. The adhesive film tears off simultaneously with locking. The spring arm integral with the supporting plate, which can, for example, bear either on the side wall of the housing or on a stop, e.g. a vertical pin in the base in the housing, enables an additional guide and mounting for a pressure spring to be dispensed with. The supporting plate merges into, i.e. is integral with, the application roller, and thus accommodates all the essential components of the unwinding device inside the housing.

A non-adhesive leader strip of the tape supply from the supply spool is preferably attached to an empty spool which can be fitted on to the take-up sleeve. A replacement unit is thus provided which consists of two spools, namely the supply spool and the empty spool, connected by the leader strip. The leader strip is advantageously connected both to the empty spool and to the leading end of the tape of the tape supply by adhesion. When the supply spool is fitted on to the wind-off sleeve and the empty spool on to the take-up sleeve, the leader strip automatically forms a loop around the application roller, and no special dexterity is needed for inserting and threading. Tearing off of the strip of adhesive tape that has been applied can be effected as in the case of the known unwinding device by engaging the lug of a brake lever in the cogwheel of the unwinding sleeve.

BRIEF DESCRIPTION OF THE DRAWINGS

The invention will now be described in more detail with reference to exemplary embodiments shown in the drawings, in which.

DETAILED DESCRIPTION OF PREFERRED EMBODIMENTS OF THE INVENTION

Figure 2:
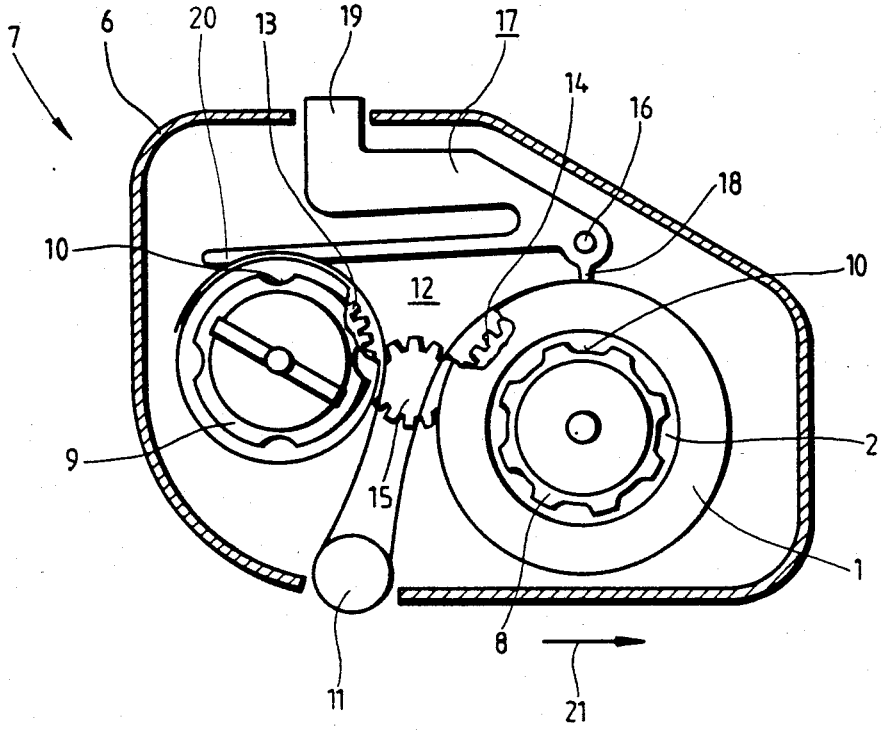
FIG. 2 is a view from above into a housing of a known unwinding device which is provided with the double spools of the invention shown in FIG. 1.

A supply spool 2 holding a supply of transfer tape 1 is connected to an empty spool 4 by a leader strip 3. Both the supply spool 2 and the empty spool 4 have axial ribs 5 projecting radially inwards. Associated with the spools 2, 4 in a housing 6 of an unwinding device 7 are a wind-off sleeve 8 and a take-up sleeve 9 (FIG. 2). The sleeves 8, 9 have axial recesses 10 which correspond to the ribs 5 of the spools 2, 4; in this way they are connected to the spools 2, 4 in a form-locking manner and when rotating transmit their rotational movement to the spools 2, 4. The axial ribs 5 have different contours to make it both visually and functionally impossible to put the spools 2, 4 on incorrectly, i.e. the supply spool 2 only fits on to the wind-off sleeve 8 and the empty spool 4 only on to the take-up sleeve 9.

The spools 2, 4 are shown in FIG. 2 mounted on the sleeves 8, 9 of a known unwinding device. The leader strip 3 is looped around an application roller 11 which is placed on an object (not shown) to transfer the adhesive tape strip or film. The sleeves 8, 9 have cogwheels 13, 14 on their sides facing the base 12 of the housing, which are operatively connected to one another by an intermediate pinion 15. A lug 18 on a brake lever 17 pivotally mounted on an axis 16 in the base 12 of the housing engages in the cogwheel 14 of the wind-off sleeve 8, and projects laterally out of the housing 6 as a push button 19. In addition, an arm 20 of the brake lever 17 bears on the take-up sleeve 9.

On bringing the application roller 11 into contact with an object and pressing the push button 19 down, the brake lever 17 pivots about the axis 16 and the lug 18 is removed from the cogwheel 14 of the wind-off sleeve 8. When the push button 19 is pushed down and the unwinding device 7 is simultaneously moved in the direction of the arrow 21, the transfer tape unwinds from the supply spool 2 and the adhesive tape is applied from the application roller onto the object to be provided with an adhesive strip. The rotational movement of the wind-off sleeve 8 with the supply spool 2 is transmitted to the take-up sleeve 9 by the cogwheels 13, 14, 15 so that the adhesive-free backing tape, i.e. the backing tape that is free from adherent double-sided adhesive tape after the application, is simultaneously wound onto the empty spool 4. As soon as the push button 19 is released the lug 18, of the brake lever 17 engages in the cogwheel 14 and prevents rotational movement, which causes the adhesive strip to be torn off.

Figure 1:
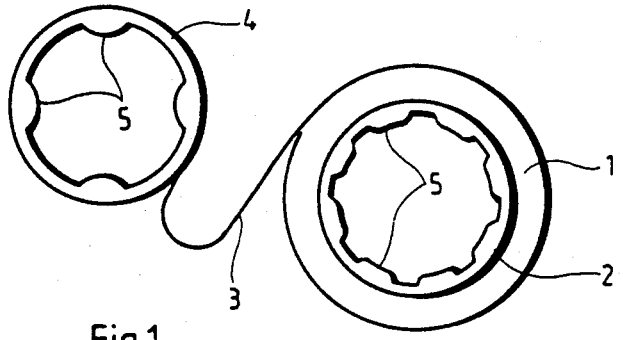
FIG. 1 shows a unit comprising the tape supply of a transfer tape supply spool connected to an empty spool by a leader strip.
Figure 3:
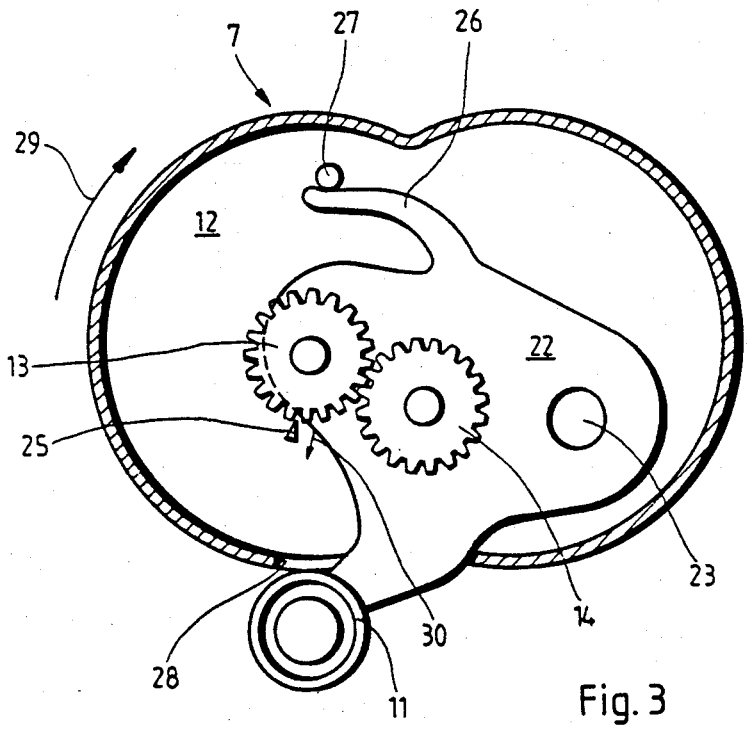
FIG. 3 is a view from above into the housing of a unwinding device according to the invention having a pivotable supporting plate for the complete unwinding mechanism.
Figure 4:
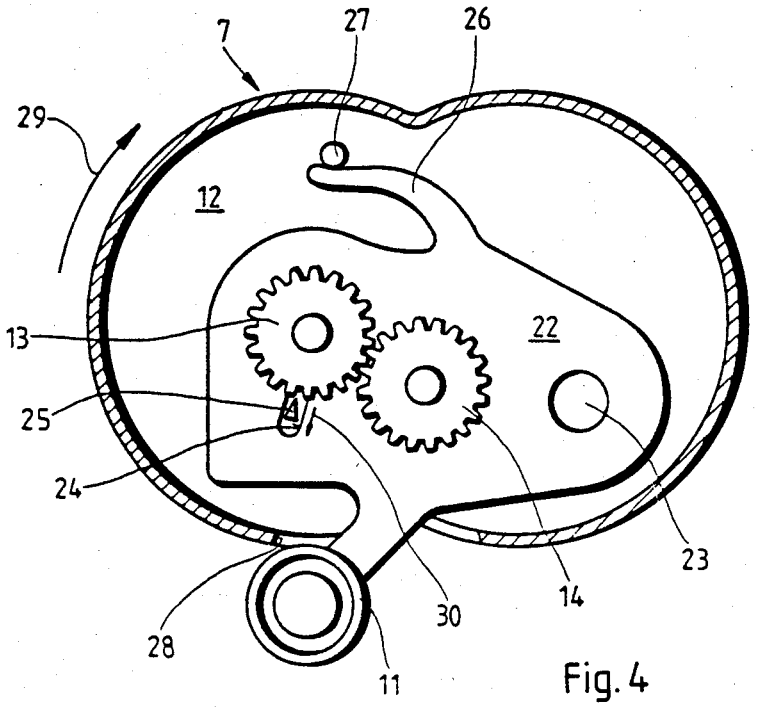
FIG. 4 shows another embodiment of the unwinding device according to the invention with a large supporting plate having a slot-like opening for a housing pin.

In the embodiment of the unrolling device 7 of the invention shown in FIG. 3 a supporting plate 22, which is mounted so as to pivot on an axis 23 in the housing floor 12, carries the complete unwinding mechanism, i.e. the wind-off and take up sleeves 8, 9 (of which, for reasons of clarity, only the associated directly intermeshing cogwheels 13, 14 are shown in FIG. 3), and continues outwards without an abrupt transition as an application roller 11; the supporting plate 22 is formed integrally with the application roller 11. The double spool exchange unit shown in FIG. 1, which comprises the tape supply 1 of the supply spool 2 connected to the empty spool 4 by the leader strip 3, and which in the case of an unwinding device without the supporting plate according to the invention (FIG. 2) is fitted on to the sleeves 8, 9 mounted in the housing floor 12, is inserted into the unwinding device 7 in a similar manner, and is consequently also carried by the supporting plate 22. A pin 25 which can engage in a tooth gap of the cogwheel 13 is attached to the base 12 of the housing. If the supporting plate 22 is so large that it covers the pin 25 it is also provided with a slot-like opening 24 into which the pin 25, which is attached in the housing floor 12 and which is wedge-shaped towards the cogwheel 13, projects (cf. FIG. 4). A spring arm 26 integral with the supporting plate 22 bears against a stop 27.

On applying the application roller 11, which projects from an opening 28 in the housing, to an object (not shown) the supporting plate pivots about its axis 23 in the direction of the arrow 29 so that the pin 25 is displaced relative to the supporting plate 22 in the direction of the arrow 30 out of the position in which it locks the cogwheel 13. The sleeves 8, 9 connected to the cogwheels 13, 14 can rotate freely, together with the spools 2, 4. When there is no load on the unwinding device 7 or the application roller 11 the spring arm 26, which bears against the stop 27, forces the supporting plate 22 in the direction opposite to the arrow 29 back into its starting position and thereby forces the pin 25 into a tooth gap of the cogwheel 14. Rotation of the cogwheels 13, 14 is therefore no longer possible and at the same time the adhesive tape strip is torn off from the backing tape.

The supporting plate 22, which can pivot about the axis 23 and which accommodates the complete unwinding mechanism, enables the pressure required to apply the adhesive tape to be used simultaneously for unlocking the cogwheels 13, 14 without the need for an additional brake lever. This is because pressure on the application roller 11, which is integral with the supporting plate 22, displaces the supporting plate 22 in the direction of the arrow 29 and separates the cogwheel 13 from the pin 25, which then no longer engages in and locks the cogwheel 13. The ease of operation of the unrolling device 7 is also helped by the coupled spools 2, 4 which form an exchange unit which can simply be fitted on the sleeves without troublesome threading, as the leader strip 3 connecting the spools 2, 4 automatically forms a loop around the application roller 11.

What is claimed is:

1. A device for unwinding from a roll a backing tape having double-sided adhesive tape adhering to it, comprising a housing containing an unwinding mechanism including a wind-off and a take-up sleeve operatively connected to one another by unlockable cogwheels and, projecting from the housing, a freely rotatable application roller around which tape being unwound from a supply spool on the wind-off sleeve to the take-up sleeve is looped, wherein a spring-loaded supporting plate carrying the unwinding mechanism is arranged in the housing to pivot about an axis in a floor of the housing having a pin which is capable of being engaged in a tooth gap of one of said cogwheels to prevent rotation of said cogwheels; whereby pressure on the application roller causes the spring-loaded supporting plate to pivot about its axis to be displaced relative to said pin to disengage said pin from said tooth gap to allow unwinding and takeup.

2. An unwinding device according to claim 1, wherein the pin is arranged in a slot opening in the supporting plate.

3. An unwinding device according to claim 1, wherein the pin is shaped as a wedge pointing towards the cogwheel.

4. An unwinding device according to claim 1, which includes a spring arm branching off from the supporting plate.

5. An unwinding device according to claim 1, wherein a leader strip of a tape supply from the supply spool is attached to an empty spool which can be fitted onto the take-up sleeve.

6. An unwinding device according to claim 5, wherein said leader strip is non-adhesive.

* * * * *